United States Patent [19]

Miyamoto et al.

[11] Patent Number: 4,639,295

[45] Date of Patent: Jan. 27, 1987

[54] ZINC PHOSPHATING METHOD

[75] Inventors: Satoshi Miyamoto, Kanagawa; Masamichi Nagatani, Tokyo, both of Japan

[73] Assignee: Amchem Products, Inc., Ambler, Pa.

[21] Appl. No.: 765,624

[22] Filed: Aug. 14, 1985

[30] Foreign Application Priority Data

Aug. 14, 1984 [JP] Japan ..... 59-170298

[51] Int. Cl.[4] ..... C25D 11/36

[52] U.S. Cl. ..... 204/38.1; 204/38.7; 204/56.1

[58] Field of Search ..... 204/38.1, 38.7, 56 R

[56] References Cited

U.S. PATENT DOCUMENTS

| | | | |
|---|---|---|---|
| 2,514,149 | 7/1950 | Amundsen | 148/6.15 |
| 2,540,314 | 2/1951 | Amundsen | 148/6.15 |
| 3,090,709 | 5/1963 | Henricks | 148/6.15 |
| 3,109,757 | 11/1963 | Reinhold | 148/6.15 |
| 3,364,081 | 1/1968 | Forsberg | 148/6.15 |
| 3,449,222 | 6/1969 | Freeman et al. | 204/38.1 |

FOREIGN PATENT DOCUMENTS

| | | | |
|---|---|---|---|
| 1187097 | 2/1965 | Fed. Rep. of Germany | 204/38.1 |

*Primary Examiner*—G. L. Kaplan

*Attorney, Agent, or Firm*—Ernest G. Szoke; Henry E. Millson, Jr.; Mark A. Greenfield

[57] ABSTRACT

A method for enhancing the corrosion resistance of a metal surface at the edge portion which comprises applying direct current to said metal surface as previously zinc phosphated as a negative electrode in an acidic solution comprising zinc ion in a concentration of 2 to 3 g/L, phosphate ion in a concentration of 8 to 14 g/L and chloride ion in a concentration of 3 to 6 g/L under the condition of 5 to 15 A/dm$^2$ (metal surface) at a temperature of 20° to 40° C. to make an electric zinc phosphate coating film having corrosion resistance.

14 Claims, 4 Drawing Figures

ZINC PHOSPHATING METHOD

BACKGROUND OF THE INVENTION

1. Field of the Invention

The present invention relates to an improved zinc phosphating method. More particularly, it relates to an improved zinc phosphating method for enhancing the corrosion resistance of a metal substrate at the edge portion.

2. Statement of Related Art

In recent years, the corrosion resistance of metal substrates has been remarkably improved by the development of zinc phosphating and the introduction of cationic electrodeposition. In a coating film formed on the surface of a metal substrate, however, blisters are frequently produced on the edge portion and develop within a short period of time. Prevention of such blister production has not been successful up to the present time.

As the result of the microscopic observation of the surface of a metal substrate which was zinc phosphated and then electrodeposition coated, it has been found that at the outer edge position, a zinc phosphate coating is present but the electrodeposition coating is almost nonexistent due to flowing on baking. In general, a zinc phosphate coating can contribute to enhancement of the corrosion resistance but does not have satisfactory corrosion resistance by itself, because of its microporosity.

BRIEF DESCRIPTION OF THE DRAWINGS

Features of the invention are described in the following with reference to the accompanying drawings wherein.

DESCRIPTION OF THE INVENTION

On the basis of the above finding, an extensive study has been made to improve the corrosion resistance at the edge portion of a metal substrate, and it has been found that application of direct current to a metal surface previously zinc phosphated by a conventional procedure as a negative electrode, in an acidic solution having a certain specific composition, results in formation of a corrosion resistant film at the edge portion. Distinguishable from a conventional zinc phosphate coating film having no corrosion resistance and which is grayish white according to this invention a corrosion resistant film is formed under the application of direct current, and is milky white. This corrosion resistant film will be hereinafter refered to as an "electric zinc phosphate coating film".

According to the present invention, there is provided an improved zinc phosphating method which comprises (B) applying direct current to a metal surface which was (A) previously zinc phosphated as a negative electrode in a solution comprising zinc ion in a concentration of 2 to 3 grams per liter, phosphate ion in a concentration of 8 to 14 grams per liter and chloride ion in a concentration of 3 to 6 grams per liter. As the result of steps (A) and (B), an electric zinc phosphate coating film having corrosion resistance is formed.

It is known to form a coating film on a metal surface dipped in a zinc phosphate solution by applying electric current thereto (see Published Japanese Patent Applications 46220/74 and 41930/80). In the foregoing conventional method, direct or alternating current of low value is applied to a metal surface to form a uniform coating of zinc phosphate. However, enhancement of the corrosion resistance by the formation of such zinc phosphate coating film can be observed only at the flat portion of the coated substrate, and improvement in the corrosion resistance is never observed at the edge portion.

Figure 1:
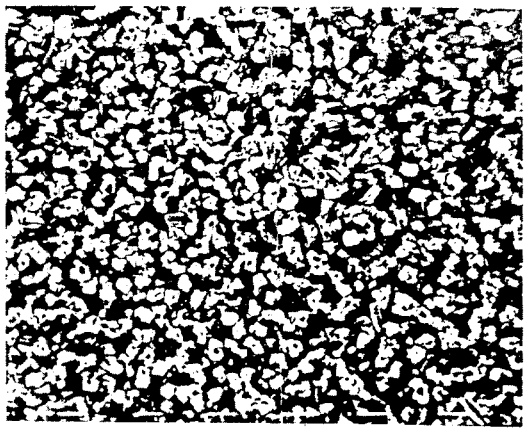
FIG. 1 shows a scanning electron microscope photograph (1500 times) of the electric zinc phosphate coating film formed by the present invention.
Figure 2:
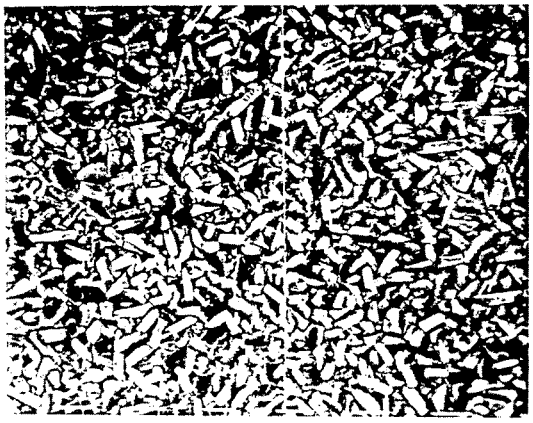
FIG. 2 shows a scanning electron microscope photograph (1500 times) of a zinc phosphate coating film obtained by conventional dipping treatment.

The difference in corrosion resistance at the edge portion between the electric phosphate zinc coating film provided by the present invention and the zinc phosphate coating film provided by the conventional method, as shown in the foregoing references, can be explained as follows: the zinc phosphate coating film obtained by conventional dipping treatment is a grayish white film, (cf. FIG. 2 of the accompanying drawing which shows the scanning electron microscopic photograph (1,500 times)), while the electric zinc phosphate coating film formed by the present invention is a milky white film (cf. FIG. 1 of the accompanying drawing which shows the scanning electron microscopic photograph (1,500 times)). On the fluoroescent X-ray analysis, the former affords a molar proportion of P/Zn of 1/1, while the latter gives a molar proportion of P/Zn of $\frac{1}{8}$. Thus, the present invention provides a zinc phosphate coating film and a coating film comprising zinc in a greater proporiton, so that corrosion resistance is greatly increased. As the result, corrosion resistance of a metal substrate, such as an automobile body, is much enhanced even at the edge portion where the coating was applied but later flows away on baking. Formation of blisters in the coating film around the edge portion is thus satisfactorily prevented. Still, a purely zinc plated metal surface is poor in adhesive property with a coating film even at the flat surface, and therefore the corrosion resistance can not be enhanced. This is also true in the case where cationic electrodeposition is applied.

In the method of the invention, a metal substrate is previously zinc phosphated. This zinc phosphating may be carried out by conventional procedures. For a metal substrate such as an automobile body, cationic electrodeposition is applied later, and in such case, dipping zinc phosphating treatment may be preferably applied in a per se conventional manner. A typical example of the treating solution for zinc phosphating may be an aqueous solution comprising the following materials: Zn ion, 0.5 to 2 g/l; $PO_4$ ion, 10 to 30 g/l; Mn ion, 0 to 2 g/l; Ni ion, 0 to 2 grams/l; $NO_3$ ion, 0 to 10 g/l; $ClO_3$ ion, 0 to 1 g/l; $NO_2$ ion, 0.01 to 0.1 g/l; and F ion, 0 to 3 g/l. The temperature for treatment may be usually from 30° to 70° C., and the time for treatment may be normally from 15 to 120 seconds. Spraying of the treating solution onto the metal surface immediately after it is taken from the treating solution for dipping is favorable for cationic electrodeposiiton as carried out later. The metal surface after the treatment may be, with or without first washing with water, sujected to electric zinc phosphating.

The metal substrate, zinc phosphated as described above is then subjected to electric zinc phosphating in an acidic solution. The acidic solution may be an aqueous solution comprising Zn ion in a concentration of 2 to 3 g/l, $PO_4$ ion in a concentration of 8 to 14 g/l and Cl ion in a concentration of 3 to 6 g/l. As the source for Zn ion, there may be used, for example, zinc oxide, zinc carbonate, zinc nitrate, etc. When the amount of zinc ion is too small, the coating film is not formed. When the amount is too large, a coating film, as formed, is a zinc phosphate coating film, not an electric zinc phosphate coating film as in our invention. Examples of the source for $PO_4$ ion are phosphoric acid, sodium phosphate, zinc phosphate, nickel phosphate, etc. When the amount of $PO_4$ ion is too small, no coating film is formed. When the amount is too large, no advantage is perceived and the process is economically unfavorable. As the source of Cl ion, there may be used sodium chloride, potassium chloride, ammonium chloride, etc. When the amount of Cl ion is too small, the electric zinc phosphate coating film of our invention is not formed; rather a zinc phosphate coating film is formed. When the amount is too great, a coating film is not formed. For the practical use of the acidic solution, it is preferred that the total acidity and the free acidity are respectively adjusted to a point of 10 to 15 and a point of 0.8 to 1.2.

Figure 3:
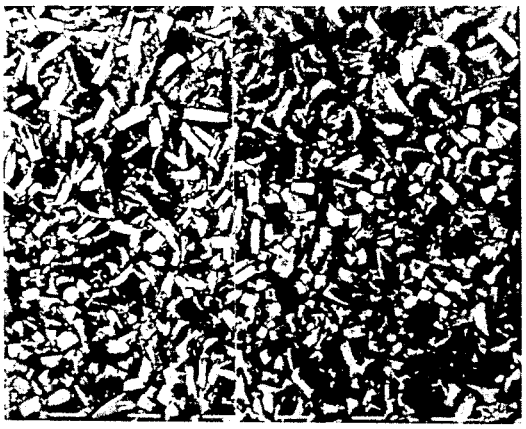
FIG. 3 shows, by a scanning electron microscope photograph (1500) times that where the temperature of the acidic solution is too low, the electric zinc phosphate coating film is not formed.
Figure 4:
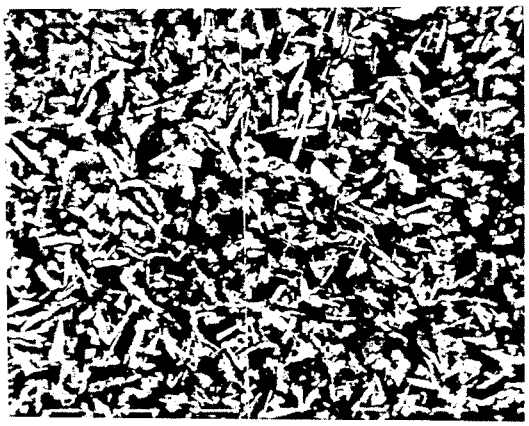
FIG. 4 shows, by a scanning electron microscope photograph (1500 times) that when the temperature of the acidic solution is too high, the resulting film does not contribute to improving the adhesiveness and corrosion resistance of the coating film.

For the electric phosphate coating, the metal surface, as zinc phosphated, is dipped in the acidic solution as the negative electrode, and direct current is applied thereto at a liquid temperature of 20° to 40° C. under a condition of 5 to 15 A/dm$^2$ (metal surface) for a period of 30 seconds to 3 minutes. The metal surface may be made of iron, zinc, their alloy or the like. For the positive electrode, there may be used stainless steel (e.g. SUS 304,316), carbon or the like. When the liquid temperature is too low, the electric zinc phosphate coating film is not formed (cf. FIG. 3 of the accompanying drawing which shows the scanning electron microscopic photograph (1,500 times)). When the liquid temperature is too high, the zinc phosphate coating film, as newly formed and also as previously formed, are first dissolved and then redeposited. The resulting coating film (cf. FIG. 4 of the accompanying drawing which shows the scanning electon microscopic photograph (1,500 times)) does not contribute to improving the adhesiveness and corrosion resistance of the coating film. In case of the electric current being low, the electric zinc phosphate coating film is not formed. In case of the elecric current being high, the once formed coating film is redissolved so that the coating film is inferior in its adhesiveness and corrosion resistance. Too short application time does not produce the electric zinc coating film, while too long application time causes redissolving of the once formed coating film.

The thus treated metal substrate, i.e. the metal substrate after electric zinc phosphating, is usually then subjected to cationic electrodeposition coating, which may be carried out by a per se conventional procedure. The thus formed electrodeposition coating film imparts good corrosion resistance to and high adhesion on the metal substrate.

Practical and presently preferred embodiments of the invention are illustratively shown in the following Examples.

EXAMPLE 1

A cleaned iron steel plate was punched to make a hole of 10 mm in diameter having a burr of about 0.1 mm in height around the hole. This plate was dipped in an aqueous zinc phosphate solution (comprising 1 g/l of Zn ion, 15 g/l of $PO_4$ ion, 0.6 g/l of Ni ion, 3 g/l of $NO_3$ ion and 0.5 g/l of $ClO_3$ ion; total acidity, 18 point; free acidity, 0.9 point, tonar value, 2 point) and treated at 50° C. for 2 minutes. The plate was washed with water and dipped in an aqueous acidic solution (comprising 2.4 g/l of Zn ion, 11 g/l of $PO_4$ ion and 4.5 g/l of Cl ion; adjusted with NaOH to a total acidity of 12 point and a free acidity of 1 point). Using the plate as the negative electrode and a carbon electrode as the positive electrode, a direct current of 10 A/dm$^2$ was applied at a liquid temperature of 30° C. for 2 minutes to make an electric zinc phosphate coating film. The plate was then washed with tap water and deionized water, followed by drying.

Onto the above treated plate, an amine-modified epoxy resin-containing cationic electrode position coating composition comprising a blocked isocyanate compound as a crosslinking agent ("Powertop U-30 black" manufactured by Nippon Paint Co., Ltd.) was applied to make a coating film of 20 microns in thickness, followed by baking at 180° for 30 minutes.

The plate before cationic electrode position coating was subjected to salt water spray test according to the method as described in JIS (JAPAN INDUSTRIAL STANDARD) Z-2371, while the plate after cationic electrode position coating was subjected to a corrosion test comprising 100 cycles, of which each cycle consists of salt water spray test (JIS, Z-2371 35° C., 2 hours), dry test (60° C., 2 hours) and wet test (50° C., relative humidity of 95%, 4 hours). Then, the blister width of the coating film from said burr was measured. The results are shown in Table 1.

COMPARATIVE EXAMPLE 1

The same treatment as in Example 1 was repeated but omitting the application of direct current in the acidic solution. The results are shown in Table 1.

TABLE 1

| | Example 1 | Comparative Example 1 |
|---|---|---|
| Amount in the zinc phosphate coating film | | |
| Zn | 2.56 g/m$^2$ | 0.57 g/m$^2$ |
| P | 0.16 g/m$^2$ | 0.27 g/m$^2$ |
| Appearance of the zinc phosphate coating film | Milky white even, dense | Grayish white even, dense |
| Plate before electrodeposition coating (salt spray test) | Red rust not produced within 24 hours | Red rust produced within 2 hours |
| Plate after electrodeposition coating (corrosion test) | Less than 1 mm | 8 mm |

PREFERRED INVENTION PARAMTERS (a) zinc ion—a range of 2 to 3 grams/liter (g/l) is both completely operable and preferred.

(b) phosphate ion—a range of 8 to 14 g/l is completely operable, the range of 10 to 12 g/l is preferred.

(c) chloride ion—a range of 3 to 6 g/l is completely operable, the range of 4 to 5 g/l is preferred.

(d) electric current—a range of 5 to 15 Amperes/square decimeter ($A/dm^2$) is completely operable in all instances, the range of 9 to 11 $A/dm^2$ is preferred.

(e) time of direct current application—a time of 30 seconds to 3 minutes is completely operable.

(f) temperature of electrolyte solution—a temperature of 15° to 50° C. is completely operable, the range of 20° to 40° C. is preferred and 25° to 35° C. is most preferred. It is important to maintain the above temperature ranges. The application of electric current within the parameters of this invention will generally result in an increase in temperature. If necessary, any known cooling means may be applied to the electrolyte solution to keep its temperature within a given range. Such means may include cooling coils, film evaporation, and the like.

We claim:

1. In a method for applying a zinc phosphate coating to a metal substrate, wherein said substrate is first given a conventional zinc phosphate coating, the improvement comprising providing a further zinc phosphate coating by using said zinc phosphate-coated substrate as a negative electrode and applying a direct current thereto, in the presence of an electrolyte solution comprising zinc ions in a concentration of 2 to 3 g/l, phosphate ions in a concentration of 8 to 14 g/l and chloride ions in a concentration of 3 to 6 g/l.

2. The method of claim 1 wherein said phosphate ion concentration is 10 to 12 g/l and said chloride ion concentration is 4 to 5 g/l.

3. The method of claim 2 wherein said direct current is applied in an amount of 5 to 15 Amperes/square decimeter, said current application is effected for 30 seconds to 3 minutes, and said electrolyte solution is maintained at a temperature of 15° to 50° C.

4. The method of claim 2 wherein said direct current is applied in an amount of 9 to 11 Amperes/square decimeter, said current application is effected for 30 seconds to 3 minutes, and said electrolyte solution is maintained at a temperature of 20° to 40° C.

5. The method of claim 4 wherein said electrolyte solution is maintained at a temperature of 25° to 35° C.

6. The method of claim 1 wherein said direct current is applied in an amount of 5 to 15 Amperes/square decimeter.

7. The method of claim 1 wherein said direct current is applied in an amount of 9 to 11 Amperes/square decimeter.

8. The method of claim 1 wherein said direct current application is effected for from 30 seconds to 3 minutes.

9. The method of claim 1 wherein said electrolyte solution is maintained at a temperature of 15° to 50° C.

10. The method of claim 1 wherein said electrolyte solution is maintained at a temperature of 20° to 40° C.

11. The method of claim 1 wherein said electrolyte solution is maintained at a temperature of 25° to 35° C.

12. The method of claim 1 wherein said direct current is applied in an amount of 5 to 15 Amperes/square decimeter, said current application is effected for 30 seconds to 3 minutes, and said electrolyte solution is maintained at a temperature of 15° to 50° C.

13. The method of claim 1 wherein said direct current is applied in an amount of 9 to 11 Amperes/square decimeter, said current application is effected for 30 seconds to 3 minutes, and said electrolyte solution is maintained at a temperature of 20° to 40° C.

14. The method of claim 13 wherein said electrolyte solution is maintained at a temperature of 25° to 35° C.

* * * * *